US006321856B1

(12) United States Patent
Alsruhe

(10) Patent No.: US 6,321,856 B1
(45) Date of Patent: Nov. 27, 2001

(54) TWO-POSITION SCREWDRIVER

(75) Inventor: Wallis Alsruhe, Millers, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/416,805

(22) Filed: Oct. 13, 1999

Related U.S. Application Data

(63) Continuation of application No. 09/174,145, filed on Oct. 16, 1998, now Pat. No. 6,102,134.

(51) Int. Cl.[7] ..... E21B 17/22

(52) U.S. Cl. ..... 173/217; 173/170; 173/216; 310/50

(58) Field of Search ..... 173/216, 217, 173/170, 117; 310/47, 50

(56) References Cited

U.S. PATENT DOCUMENTS

| | | |
|---|---|---|
| 138,716 | 5/1873 | Tobey . |
| D. 301,496 | 6/1989 | Yonesawa et al. . |
| D. 304,419 | 11/1989 | Henck et al. . |
| D. 305,975 | 2/1990 | Emmerling . |
| D. 344,439 | 2/1994 | Izumisawa . |
| D. 380,658 | 7/1997 | Bruno et al. . |
| 901,700 | 10/1908 | Filson . |
| 984,778 | 2/1911 | Remisch . |
| 1,300,621 | 4/1919 | Key . |
| 1,301,802 | 4/1919 | Anderson . |
| 1,363,715 | 12/1920 | Brown . |
| 1,652,980 | 12/1927 | Glass . |
| 1,665,240 | 4/1928 | Weaver . |
| 1,835,943 | 12/1931 | Hoss . |
| 2,542,038 | 2/1951 | Lewis . |
| 2,572,444 | 10/1951 | Carden . |
| 2,617,619 | 11/1952 | Versen . |
| 2,630,730 | 3/1953 | Thornton . |
| 2,789,597 | 4/1957 | La Torre . |
| 2,890,613 | 6/1959 | Monckton . |
| 3,322,886 | 5/1967 | Warshawsky . |
| 3,509,629 | 5/1970 | Kidokoro . |
| 3,528,510 | 9/1970 | Peterson . |
| 3,552,786 | 1/1971 | Schmid . |
| 3,687,179 | 8/1972 | Totsu . |
| 3,905,429 | 9/1975 | Berger . |

(List continued on next page.)

FOREIGN PATENT DOCUMENTS

| | | |
|---|---|---|
| 33 23 088 C2 | 7/1984 | (DE) . |
| 33 17 832 C2 | 3/1986 | (DE) . |
| 3542637 A1 | 6/1987 | (DE) . |
| 36 02 992 A1 | 8/1987 | (DE) . |
| 87 06 612.2 | 8/1987 | (DE) . |
| 33 22 876 C3 | 10/1991 | (DE) . |
| 41 16 343 A1 | 11/1992 | (DE) . |
| 43 30 728 C2 | 6/1995 | (DE) . |
| 43 40 740 A1 | 6/1995 | (DE) . |
| 43 42 464 A1 | 6/1995 | (DE) . |
| 0 280 527 A2 | 8/1988 | (EP) . |

*Primary Examiner*—Scott A. Smith
(74) *Attorney, Agent, or Firm*—Harness, Dickey & Pierce, P.L.C.

(57) ABSTRACT

A two-position tool has a pair of housing members rotatable with respect to one another. A locking mechanism is coupled with one of the housing members to lock the two housing members in a plurality of positions with respect to one another. In a first position, the axes of the housing members are substantially colinear with one another and in a second position, the axes are angled with respect to one another. The locking mechanism includes an activation member and a pin coupled with the activation member. A detent member is coupled with one of the housing members. The detent member has a plurality of detents to receive the movable pin to lock the housing member in the plurality of positions.

12 Claims, 4 Drawing Sheets

U.S. PATENT DOCUMENTS

| | | |
|---|---|---|
| 3,973,605 | 8/1976 | DeCaro . |
| 3,986,272 | 10/1976 | Feierabent . |
| 4,158,970 | 6/1979 | Laughon . |
| 4,215,594 | 8/1980 | Workman, Jr. et al. . |
| 4,332,147 | 6/1982 | Grech . |
| 4,347,450 | 8/1982 | Colligan . |
| 4,522,270 | 6/1985 | Kishi . |
| 4,759,240 | 7/1988 | Lin . |
| 4,912,349 | 3/1990 | Chang . |
| 4,962,681 | 10/1990 | Yang . |
| 4,976,173 | 12/1990 | Yang . |
| 5,372,420 | 12/1994 | Van Deursen et al. . |
| 5,515,754 | 5/1996 | Elkins . |
| 5,533,581 | 7/1996 | Barth et al. . |
| 5,737,982 | 4/1998 | Lin . |

TWO-POSITION SCREWDRIVER

This is a continuation of U.S. patent application Ser. No. 09/174,145, filed Oct. 16, 1998 now U.S. Pat. No. 6,102, 134.

BACKGROUND OF THE INVENTION

The present invention relates to hand held power tools and, more particularly, to hand held power tools which move to a plurality of positions.

Hand held power tools are utilized by general consumers as well as professional tradesmen. Hand held power tools have replaced the burdensome turning and rotation of manual hand tools. Specifically, in the screwdriver field, hand held power screwdrivers have become extremely popular. Hand held power screwdrivers ordinarily have the rotatable spindle co-axial with the screwdriver housing. When a drill motor is utilized with a screwdriver bit, the spindle is ordinarily at a 90° angle with respect to the drill motor handle.

When utilizing a stick type of power screwdriver, sometimes it is desirable to utilize the power screwdriver at various angles with respect to the workpiece. However, while the screwdriver is positioned at the varied angle, it does not always enable the user to have an adequate grip on the screwdriver to provide a desired force.

Accordingly, various types of positionable tools have served this function. Positionable tools ordinarily have a first position where the spindle. is co-axial with the tool housing and a second position where the spindle is angled with respect to the tool housing. Thus, the user, when necessary, angles the spindle with respect to the remaining portion of the housing to enable a better grip on the power tool. The better positioning of the spindle enables the user to provide a desired force onto the fastener.

Several types of positionable tools exist in the art. While these tools appear to be satisfactory for their intended purpose, designers strive to improve the art.

SUMMARY OF THE INVENTION

The present invention provides the art with a positionable hand held power tool. The power tool is provided with a mechanism to actively retain the housing portions in a plurality of positions with respect to one another. The present invention provides an active bias member to lock the housing portions with respect to one another.

In accordance with a first aspect of the invention, a tool operated in a plurality of positions comprises two housing members each defining an axis. A pivot couples the two housing members for pivotal movement with respect to one another. A lock mechanism is coupled with one of the housing members for locking the two housing members in a plurality of positions with respect to one another. In a first position, the axes of the housing members are generally colinear. In a second position, the axes are angled with respect to one another. The lock mechanism includes an activation member. A movable pin is coupled with the activation member. A detent member is coupled with one of the housing members. The detent member includes a plurality of detents for receiving a movable pin to lock the housing members in one of the plurality of positions. A guide mechanism is also present which directs the movement of the movable pin. The guide mechanism enables movement of the pin in a plurality of directions. The guide mechanism includes a member extending from the activation member which includes a slot to receive the pin and enable movement of the pin in the slot. The guide mechanism also includes at least one channel on one of the housing members for guiding movement of the pin. A biasing member is coupled with the activation member to apply a force on the pin to maintain the pin in the detents. The activation member is moved to remove the pin from a detent to enable pivoting of the housing members with respect to one another. Also the detent member includes a cam surface to move the pin in a desired direction.

In accordance with a second aspect of the invention, a two-position tool is disclosed comprising two housing members with a pivot coupling the two members together with one another to enable pivoting of the two members with respect to one another. At least two detents are on one of the housing members. A pin is on the other of the housing members and is movable in two directions to be received in at least two detents to maintain the housing members in at least two positions with respect to one another. A biasing member applies a force on the pin to actively maintain the pin in the detents. A guide member is coupled with one of the housing members to guide the pin in a first direction. A second guide member is on the other housing to guide the pin in a second direction. An activation member is coupled with the pin to move the pin in and out of the detents.

In accordance with a third aspect of the invention, a two-position tool comprises a pair of housing members pivotal with respect to one another. One of the housing members has at least two detents. A pin is on the other housing member to be received by the detents. The pin is movable and biased such that as the pin moves out of one detent, the housing members may be pivotal with respect to one another and the biased pin is forced into the other detent to maintain a tool in a second position. A guide member is coupled with one of the housing members to guide the pin in a first direction. A second guide member is on the other housing member to guide the pin in a second direction. An activation member is coupled with the pin to move the pin in and out of the detents. The guide mechanism includes a member extending from the activation member which includes a slot to receive the pin. The pin is movable in the slot. The second guide members includes at least one channel in the housing member to guide movement of the pin. A biasing member is coupled with the activation member to apply a force on the pin to actively maintain the pin in the detents. The detent member also includes a cam surface to move the pin.

From the following detailed description, taken in conjunction with the accompanying drawings and subjoined claims, other objects, features and advantages of the present invention will become more fully apparent to one skilled in the art.

DETAILED DESCRIPTION OF THE PREFERRED EMBODIMENT

Figure 1:
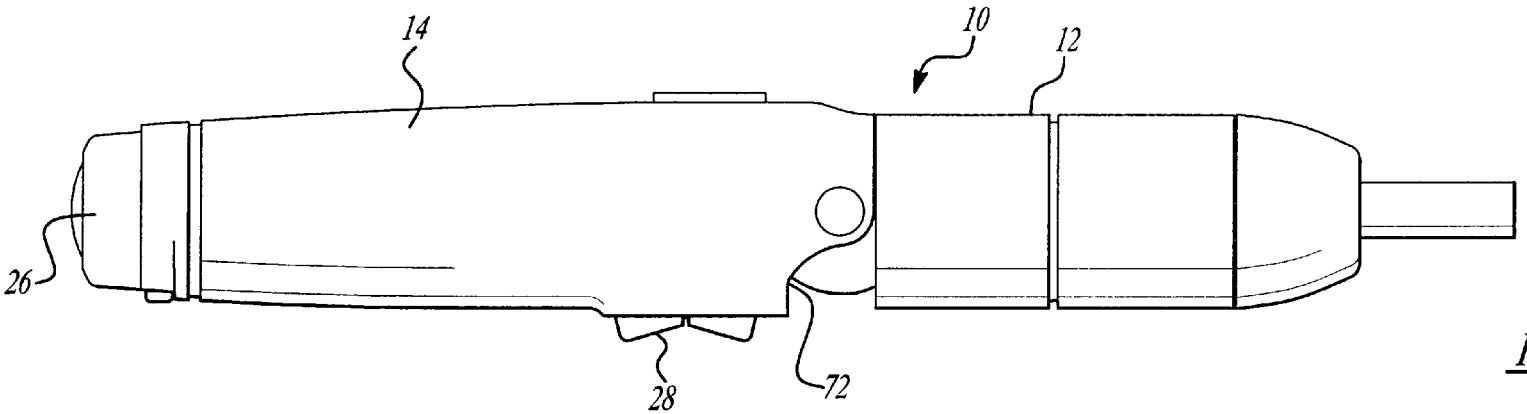
FIG. 1 is a plan view of a two-position hand tool in accordance with the present invention.

Turning to the figures, a hand held power tool is illustrated and designated with the reference numeral 10. The power tool 10 includes a first housing member 12 and a second housing member 14. The housing members 12 and 14 are pivotal with respect to one another. The housing portion 12 includes a motor 18 driving a transmission 20 which, in turn, drives the output spindle 22. The second housing member 14 includes a cavity 24 to receive a battery 26. A switch 28 is electrically coupled with the battery 26 and the motor 18 to drive the spindle in a forward and reverse direction.

The first housing member 12 includes a pair of clam shell halves 30 and 34 which are coupled with one another to form the housing member 12. The housing member 12 includes a rear portion 40 which opposes the spindle 22. The rear portion 40 includes an aperture 42 to receive a pivot 44 from the second housing member 14. Also, the rear portion includes a pair of detents 46 and 48 separated by a cam surface portion 50. The detents 46 and 48 are on the outer arcuate periphery of the rear portion 40. Also, the rear portion 40 includes a second aperture 52 to enable electrical wires, which extend to the motor, to pass into the second housing member 14.

The second housing member 14 includes a pair of clam shell housing halves 60 and 62. The housing halves 60 and 62 define apertures 64, 66 and 68. Aperture 66 receives the motor forward and reverse switch 28. The aperture 64 receives an activating member 70. Aperture 68 receives the rear portion 40 of the first housing member 12. The housing portion 14 also includes a cut-out portion 72 which enables the first housing portion 12 to rotate into the cut-out portion 72.

The activation member 70 is slidable in a channel 74 in the housing halves 60 and 62. The activation member 70 has an extending member 78 which receives a biasing member 80. One end of the biasing member 80 rests against an abutting wall 82 in the housing member 14. The biasing member 80 provides an active force on the activation member 70. The activation member 70 also includes a pair of extending fingers 84 and 86. The fingers 84 and 86 include oblong slots 88. A pin 90 is received within the slots 88. The slots 88 enable the pin to move within the slots in a first direction as the activation member 70 is slid along channel 74. A pair of guide channels 94 and 96 are formed on the interior surfaces of the housing halves 60 and 62. The guide channels 94 and 96 each receive an end of the pin 90. The guide channels 94 and 96 enable the pin to slide within the channels 94 and 96 in a second direction as the activation member 70 is moved in the channel 74.

Figure 3:
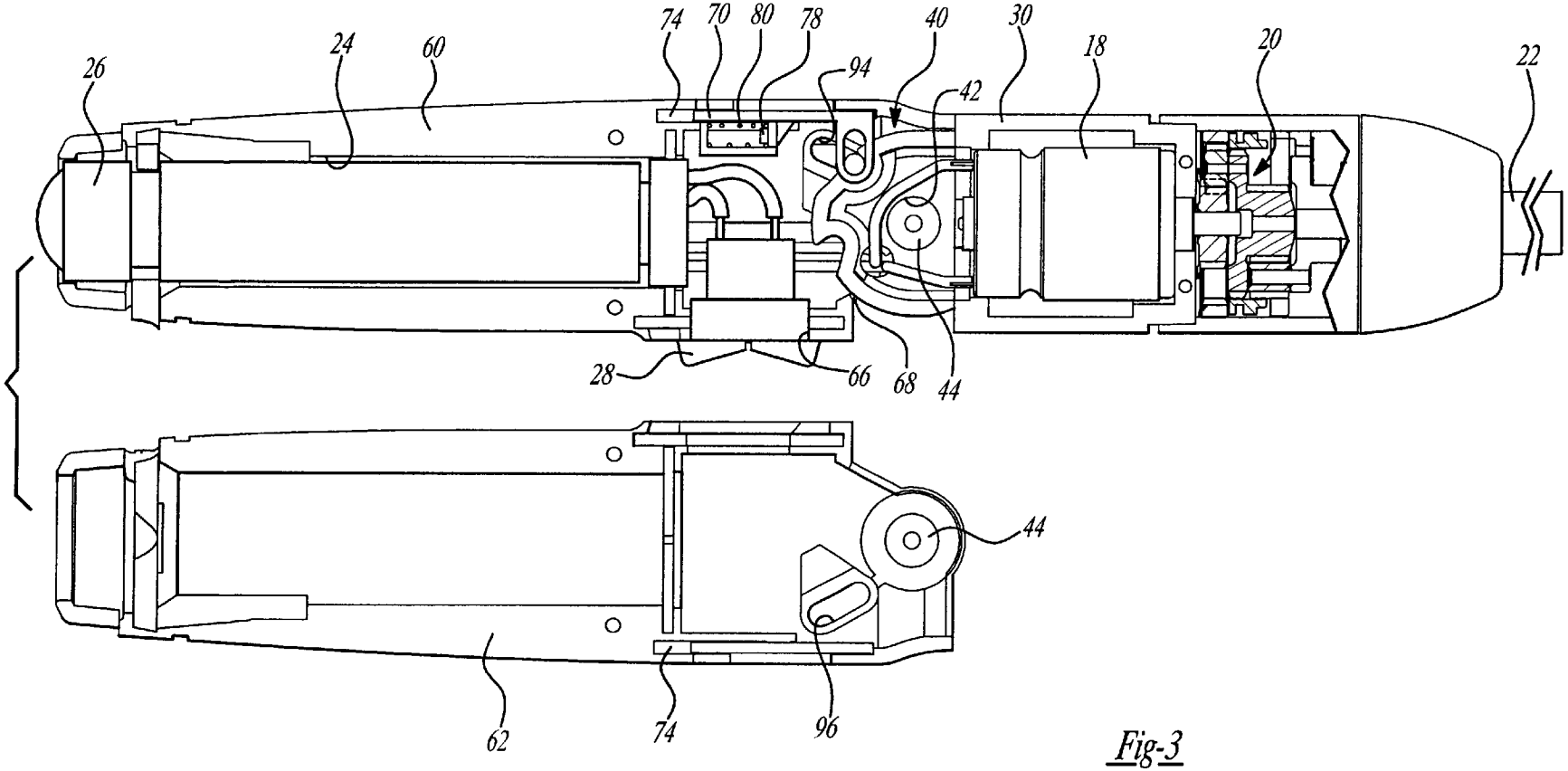
FIG. 3 is a cross-section view along line 3—3 of FIG. 1 with an inside plan view of the housing.
Figure 4:
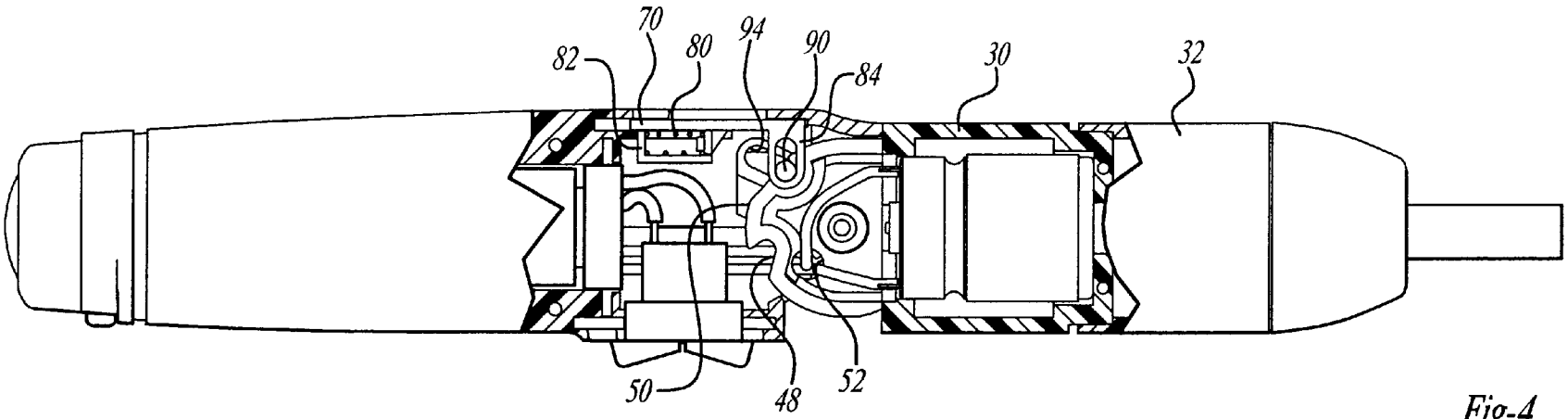
FIG. 4 is a partial cross-section view of the housing of FIG. 1.
Figure 5:
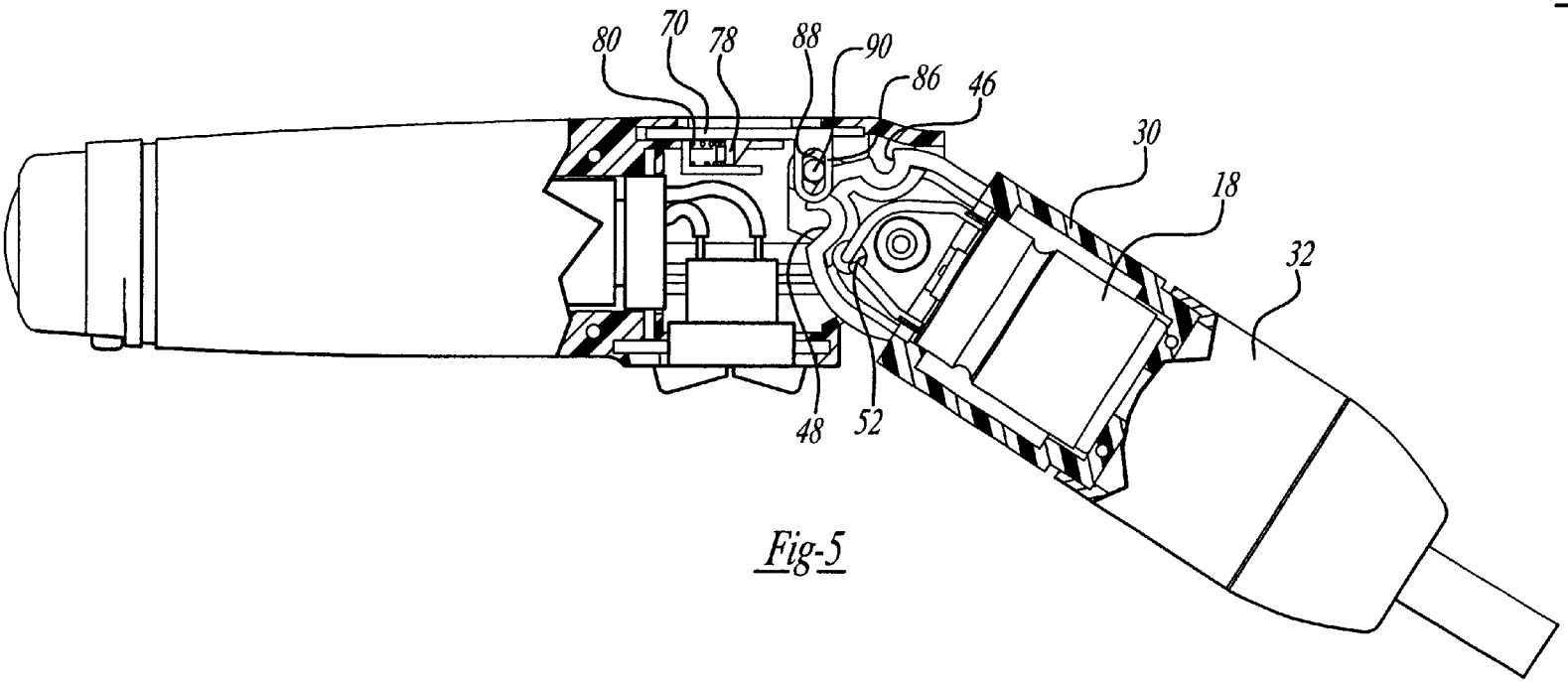
FIG. 5 is a partial cross-section view like FIG. 4 during rotation of the housing members with respect to one another.
Figure 6:
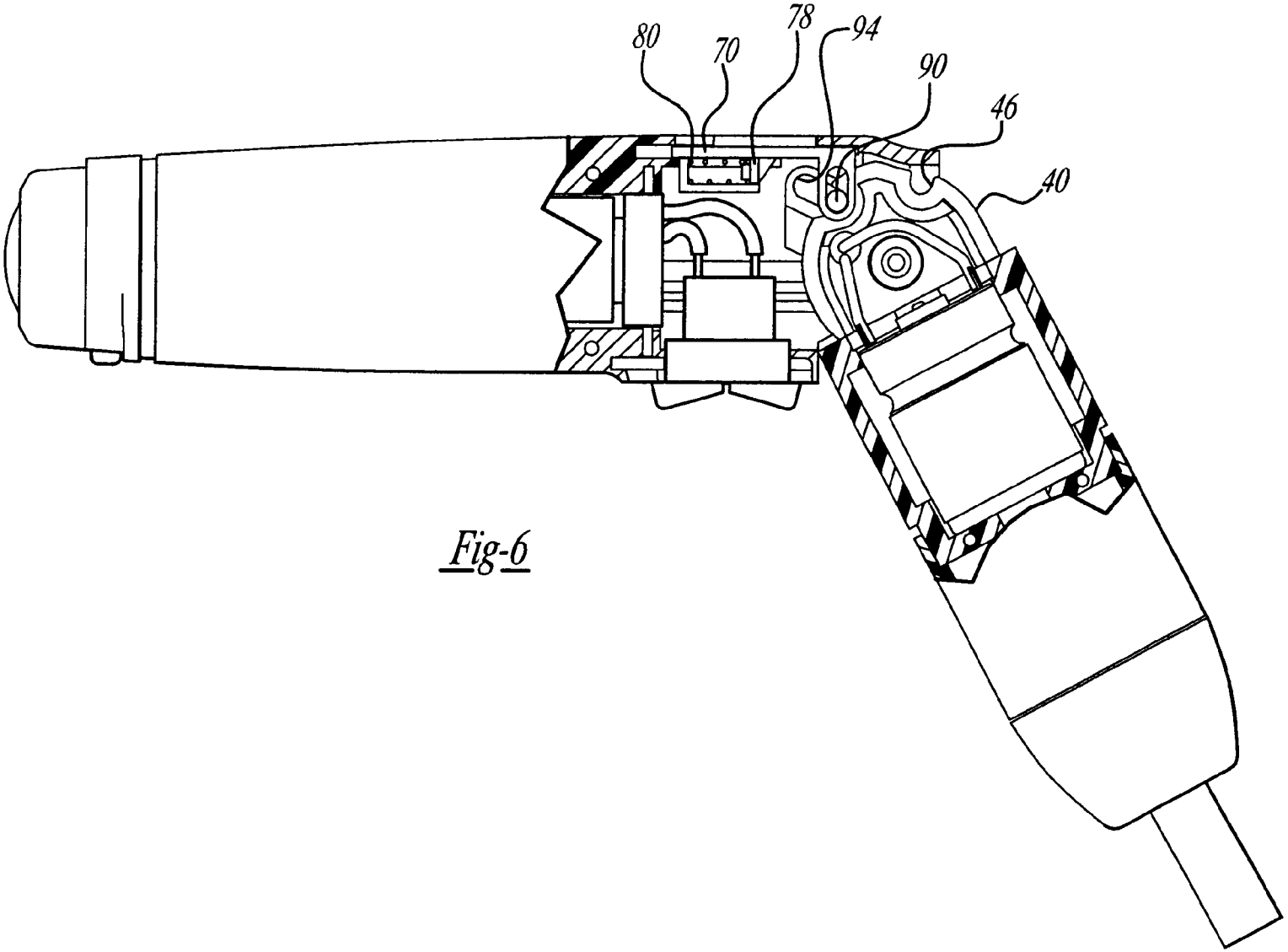
FIG. 6 is a view like FIG. 5 in a second position.

Turning to FIGS. 3–6, a better understanding of the activation member 70 will be described. As seen in FIG. 3, the pin 90 is actively biased in detent 46. The pin locks the housing members in a first position with respect to one another. The activation member 70 is then moved along channels 74 against the biasing force of spring 80. As this occurs, the pin 90 is moved along channels 94 and 96 of the housing halves 60 and 62. In order to move the housing members 12 and 14 with respect to one another, the housing members 12 and 14 are pivoted with respect to one another. When releasing the force on the actuation member 70, the biasing spring exerts a force which acts on the pin 90, forcing it against the surface 50. As the end of the cam surface 50 passes the pin 90, the biasing spring 80 actively forces the pin 90 into detent 48 to lock the motion. Thus, the housing members 12 and 14 are locked in a second position with respect to one another. While two detents are illustrated in the periphery of the housing member 12, more detents could be added to lock the housing members in additional positions with respect to one another.

Figure 2:
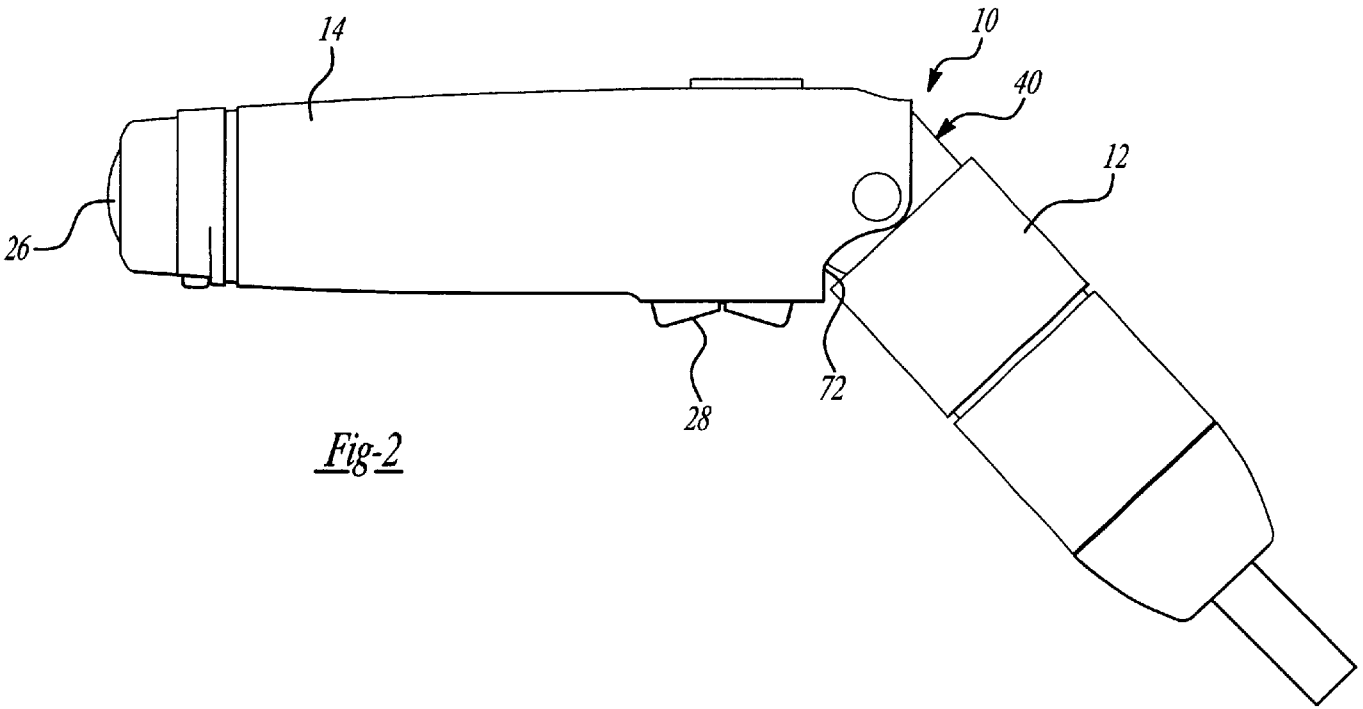
FIG. 2 is a plan view of the tool of FIG. 1 in a second position.

Turning to FIGS. 1 and 2, the hollow cylindrical housing member 14 of screwdriver 10 includes switch 28 and activation member 70 oppositely opposed on housing member 14. These members are positioned approximately one hundred eighty (180°) degrees apart on the cylindrical housing member 14. Thus, the user may easily use one hand to operate the activation member 70 with his thumb while operating the pivot switch 28 with his fingers. The user may use his index and middle fingers or just one of the fingers to operate the pivot switch 28 in the forward and reverse directions. The user's thumb would be on the activation member 70 sliding it in a forward and backward manner. This provides a very ergonomical design such that the screwdriver 10 is easily manipulated by the user with a single hand.

The screwdriver 10 may be operated in the position shown in FIG. 1 and, during operation, pivoted to the position illustrated in FIG. 2. Thus, if needed, the screwdriver can be pivoted during operation. Also, the user may move the housing 12 with respect to the housing 14 by quickly moving the user's hand which, in turn, provides a sudden force on the housing member 12 with respect to the grip housing member 14 so that the housing 12 can pivot between its first and second positions as illustrated in FIGS. 1 and 2 by movement of a single hand motion. Thus, by a flip of the user's hand, with the activation member 70 in a retracted position, the housing member 12 can move between its first and second position as shown in FIGS. 1 and 2. Then the housing members 12 and 14 are locked in position when the activation member 70 returns to its original position. While the above detailed description describes the preferred embodiment of the present invention, the invention is susceptible to modification, variation, and alteration without deviating from the scope and fair meaning of the subjoined claims.

What is claimed is:

1. A power tool comprising:

two housing members pivotally coupling with one another;

a power source coupled with one of said housing members;

a motor coupled with said power source and the other of said housing members, an output coupled with said motor;

a switch coupled with said power source and motor for energizing and de-energizing said motor for rotating said output, said switch positioned on said housing member including said power source;

a lock coupled with said housing member including said power source for locking said two housing members in a plurality of positions with respect to one another such that in a first position axes of said housing members are substantially colinear and in a second position, said axes are angled with respect to one another and said housing axes remain in a single plane during movement between said first and second position; and an activation member for actuating said locking member, said actuation member positioned on the same housing member as said switch such that said actuation member and switch oppose one another on said housing member and said housing members being movable by a single hand of the user for pivoting said housing members with respect to one another.

2. The power tool according to claim 1, wherein said activation member being slidable and said switch being pivotable.

3. The power tool according to claim 1, wherein when said activation member is in a retracted position, said housing members are movable with respect to one another upon sudden movement of the screwdriver by the user.

4. The power tool according to claim 3 wherein said activation member being spring biased to return to its original position.

5. The power tool according to claim 1, wherein said activation member and switch are ergonomically positioned with respect to one another for operation by the user's thumb and fingers of a single hand.

6. The power tool according to claim 1, wherein said housing members being enabled to pivot with respect to one another during operation of said motor.

7. The power tool according to claim 6, wherein said pivoting occurring while the axes move from a colinear position to an angled position.

8. The power tool according to claim 1, wherein a battery is in said power source housing member and said motor is in the other said housing member.

9. A power tool comprising:

two housing members;

a pivot defining an axis, said pivot coupling together one of said housing members pivotally with the other of said housing members such that said housing members hinge about the pivot axis;

a power source coupled with one of said housing members;

a motor coupled with said power source and one of said housing members, an output coupled with said motor;

a switch coupled with said power source and motor for energizing and de-energizing said motor for rotating said output, said switch positioned on said housing member including said power source, and said switch positioned immediately adjacent said pivot;

a lock coupled with one of said housing members for locking said two housing members in a plurality of positions with respect to one another such that in a first position axes of said housing members are substantially colinear and in a second position, said axes are angled with respect to one another and said housing axes remain in a single plane during movement between said first and second position; and an activation member for actuating said locking member, said actuation member positioned on one of said housing members, said actuation member is movable by the user for pivoting said housing members with respect to one another.

10. A power tool comprising;

two hosing members;

a pivot defining a pivot axis, said pivot coupling together one of said housing members pivotally with the other of said housing members such that said housing members hinge about said pivot axis;

a power source coupled with one of said housing members;

a motor coupled with said power source and one of said housing members, an output coupled with said motor;

a switch coupled with said power source and motor for energizing and de-energizing said motor for rotating said output, said switch positioned on one of said housing members;

a lock coupled with one of said housing members for locking sad two housing members in a plurality of positions with respect to one another such that in a first position axes of said housing members are substantially colinear and in a second position, said axes are angled with respect to one another and said housing axes remain in a single plane during movement between said first and second position, said lock mechanism including a latch member for positively locking said two housing members with respect to one another in each of said plurality of positions; and an activation member for actuating said locking member, said actuation member positioned on one of said housing member, enabling the user to pivot said housing members with respect to one another.

11. A power tool comprising:

two housing members pivotally coupling with one another;

a power source coupled with one of said housing members;

a motor coupled with said power source and one of said housing members, an output coupled with said motor;

a switch coupled with said power source and motor for energizing and de-energizing said motor for rotating said output, said switch positioned on one of said housing members;

a lock coupled with one of said housing members for locking said two housing members in a plurality of positions with respect to one another such that in a first position axes of said housing members are substantially colinear and in a second position, said axes are angled with respect to one another and said housing axes remain in a single plane during movement between said first and second position, said lock mechanism including a latch member for positively locking said two housing members with respect to one another in each of said plurality of positions; and an activation member for actuating said locking member, said actuation member positioned on one of said housing members such that the activation member is movable by a single hand of the user and said housing member being enabled to pivot with respect to one another by the single hand of the user.

12. A power tool comprising:

two housing members;

a pivot defining a pivot axis, said pivot coupling together one of said housing members with the other of said housing members such that said housing members hinge about said pivot axis;

a power source coupled with one of said housing member;

a motor coupled with said power source and the other of said housing members, an output coupled with said motor;

a switch coupled with said power source and motor for energizing and de-energizing said motor for rotating said output, said switch positioned on said housing member including said power source;

an aperture in one of said housing members enabling leads to pass between said two housing members for electrically coupling said power source with said motor;

a lock coupled with said housing member including said power source for locking said two housing members in a plurality of positions with respect to one another such that in a first position axes of said housing members are substantially colinear and in a second position, said axes are angled with respect on one another and said housing axes remain in a single plane during movement between said first and second position; and an activation member for actuating said locking member.

* * * * *